US005649729A

United States Patent [19]

Peterson

[11] Patent Number: 5,649,729

[45] Date of Patent: Jul. 22, 1997

[54] SINGLE LINE GRAB SYSTEM

[75] Inventor: Robert L. Peterson, Beaverton, Oreg.

[73] Assignee: Allied Power Products Inc., Beaverton, Oreg.

[21] Appl. No.: 654,887

[22] Filed: May 29, 1996

[51] Int. Cl.[6] ..... B66C 3/06

[52] U.S. Cl. ..... 294/68.23; 294/112; 37/184; 254/337; 254/391

[58] Field of Search ..... 294/68.23, 66.1, 294/106, 107, 111, 112; 37/184–188; 414/624, 625; 254/336, 337, 391

[56] References Cited

U.S. PATENT DOCUMENTS

| | | | |
|---|---|---|---|
| 226,557 | 4/1880 | Seward . | |
| 376,242 | 1/1888 | Barrows . | |
| 866,628 | 9/1907 | Crowson . | |
| 1,062,208 | 5/1913 | Williams | 37/184 |
| 1,258,833 | 3/1918 | Venable . | |
| 1,301,626 | 4/1919 | Watters . | |
| 1,514,000 | 11/1924 | Kjode | 37/188 |
| 1,717,549 | 6/1929 | Brosius | 294/68.23 |
| 1,869,989 | 8/1932 | Venable . | |
| 3,036,393 | 5/1962 | Baird, Jr. | 37/184 |
| 3,102,752 | 9/1963 | Jenkins | 294/111 |
| 3,934,917 | 1/1976 | Paxton et al. | 294/70 |
| 4,328,987 | 5/1982 | Zoudlik | 294/111 |
| 4,351,417 | 9/1982 | Seiz et al. | 254/391 |
| 5,404,978 | 4/1995 | Hagiwara | 192/58 |
| 5,419,417 | 5/1995 | Madsack | 192/58 |

*Primary Examiner*—Dean Kramer
*Attorney, Agent, or Firm*—Chernoff Vilhauer McClung & Stenzel

[57] ABSTRACT

A single line grab system including a grab suspended by a single line from a carrier. A head assembly is connected to the grab from above the grab and is vertically movable with respect thereto. A first end of the line is anchored and second end of the line is selectively extensible and retractable. A retarder system selectively engages a portion of the line. In one embodiment of the grab system the retarder is mounted on the head assembly and the first end of the line is anchored to the carrier. In an alternate embodiment of the grab system the retarder is mounted on the carrier and the first end of the line is anchored to the head assembly. A method for operating a grab system essentially involves two variables: first, the line may be selectively withdrawn or fed and, second, the retarder may be selectively disabled or applied to a portion of the line. Using these two variables, the grab or bucket may be selectively opened or closed and selectively raised or lowered.

23 Claims, 4 Drawing Sheets

SINGLE LINE GRAB SYSTEM

BACKGROUND OF THE INVENTION

The present invention relates to an improved single line grab system.

Conventional "2-line grabs," require both a holding line and a closing line. A grab, such as a bucket having two parts connected by a central pivot, may be raised and lowered when a brake is in a released position so that the holding line moves freely through the brake. To open the bucket, the brake is applied to the holding line to create tension. As the closing line is fed, the bucket pivot lowers and the bucket opens. Conventional "2-line grabs" are difficult to operate in that they usually require the operator to use multiple clutches, brakes, and a throttle. One such "2-line grab" is disclosed in U.S. Pat. No. 4,528,987 to Zoudlik.

Traditional "single line grabs" use a single line to raise and lower the bucket. One method traditionally used to open/close the bucket is a "bump and go" method in which the bucket remains closed until it "bumps" a surface such as the ground at which point it opens. The bucket is closed by raising the bucket off the surface. One such "bump and go method" is disclosed in U.S. Pat. No. 3,934,917 to Paxton et al. The "bump and go" system does not allow the load in a bucket to be emptied from an elevated position, and thereby requires additional time to lower the load prior to opening the bucket.

An alternate method traditionally used to open and close a bucket in a single line grab is to include a hydraulic system which opens and closes the bucket. One problem with hydraulic systems is that they often leak (which contaminates the contents of the bucket). Another problem with hydraulic systems is that they generally cannot be used under water.

U.S. Pat. No. 3,036,393 to J. Baird, Jr. discloses an alternate "single line" hoisting bucket that includes a clamshell grab suspended by a single line. A second line, however, is used to release the clamshells. More specifically, the Baird device requires an operator to pull a second line to release a cocker hook from a sleeve portion of a pivot shaft between the clamshells. The Baird device also requires a counterweight assembly block which lowers the cocker hook to engage with the pivot shaft and raises when the cocker hook is not engaged.

Other patents such as U.S. Pat. No. 226,557 to W. H. Seward, U.S. Pat. No. 376,242 to F. B. Barrows, U.S. Pat. No. 1,301,626 to W. E. Watters, and U.S. Pat. No. 1,869,989 to W. M. Venable, disclose devices which, like the above described apparatuses, are "bump and go" systems, require additional lines or release apparatus, include complicated raising and lowering assemblies, or otherwise are needlessly complicated.

SUMMARY OF THE INVENTION

What is needed then is a relatively simple single line grab system that solves the problems associated with the previous systems by allowing a user to control the raising and lowering of a grab as well as the opening and closing of the grab using a single line.

A single line grab system according to the present invention, includes a grab, having at least two grab members pivotably interconnected by a central pivot assembly. A head assembly is connected to the grab from above and is vertically movable with respect thereto. A single line that is anchored at a first end suspends the grab from a carrier. A second end of the line is selectively extensible and retractable. A retarder system selectively engages a portion of the line and is preferably controlled solely through the speed of the line through the system.

In one embodiment of the grab system the retarder is mounted on the head assembly and the first end of the line is anchored to the carrier. In an alternate embodiment of the grab system the retarder is mounted on the carrier and the first end of the line is anchored to the head assembly.

A method for operating a grab system essentially involves two variables: first, the line may be selectively withdrawn or fed and, second, the retarder may be selectively disabled or applied to a portion of the line. Using these two variables, the grab or bucket may be selectively opened or closed and selectively raised or lowered.

One advantage of this improved system is that it is easily retrofitted to the prior art grabs.

The foregoing and other objectives, features, and advantages of the invention will be more readily understood upon consideration of take following detailed description of the invention, taker in conjunction with the accompanying drawings.

DETAILED DESCRIPTION OF THE PREFERRED EMBODIMENT

Figure 5:
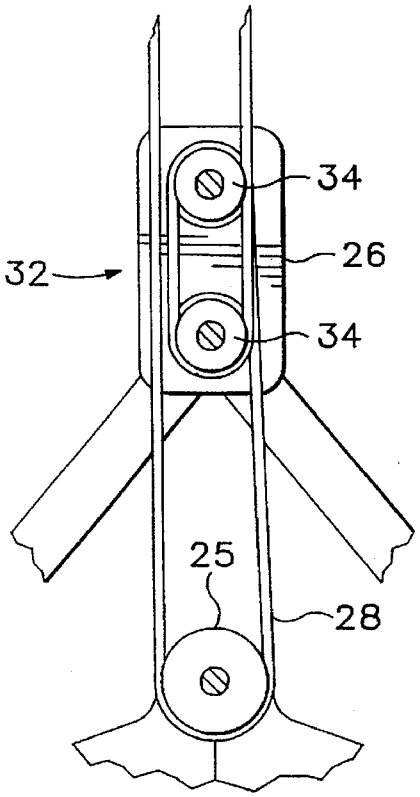
FIG. 5 is a cross-sectional view of the retarder system of FIG. 1.

Two different exemplary embodiments of a single line grab system, indicated generally as 20 and 20', are shown in FIGS. 1–4. Each grab system 20, 20' generally includes a grab, shown as bucket 22, having at least two bucket members **22*a* and 22*b* pivotably interconnected by a central pivot assembly 24 having a pulley 25. A head assembly 26 or 26' is connected to the bucket members 22*a* and 22*b* from above the bucket 22 and is vertically movable with respect to the bucket 22. A continuous single line 28 that is anchored at a first end 28*a* suspends the bucket 22 from a carrier or boom 30 or 30'. A second end 28*b* of the line is selectively extensible and retractable. A selectively actuated retarder 32 engages a portion of the line 28**.

Figure 1:
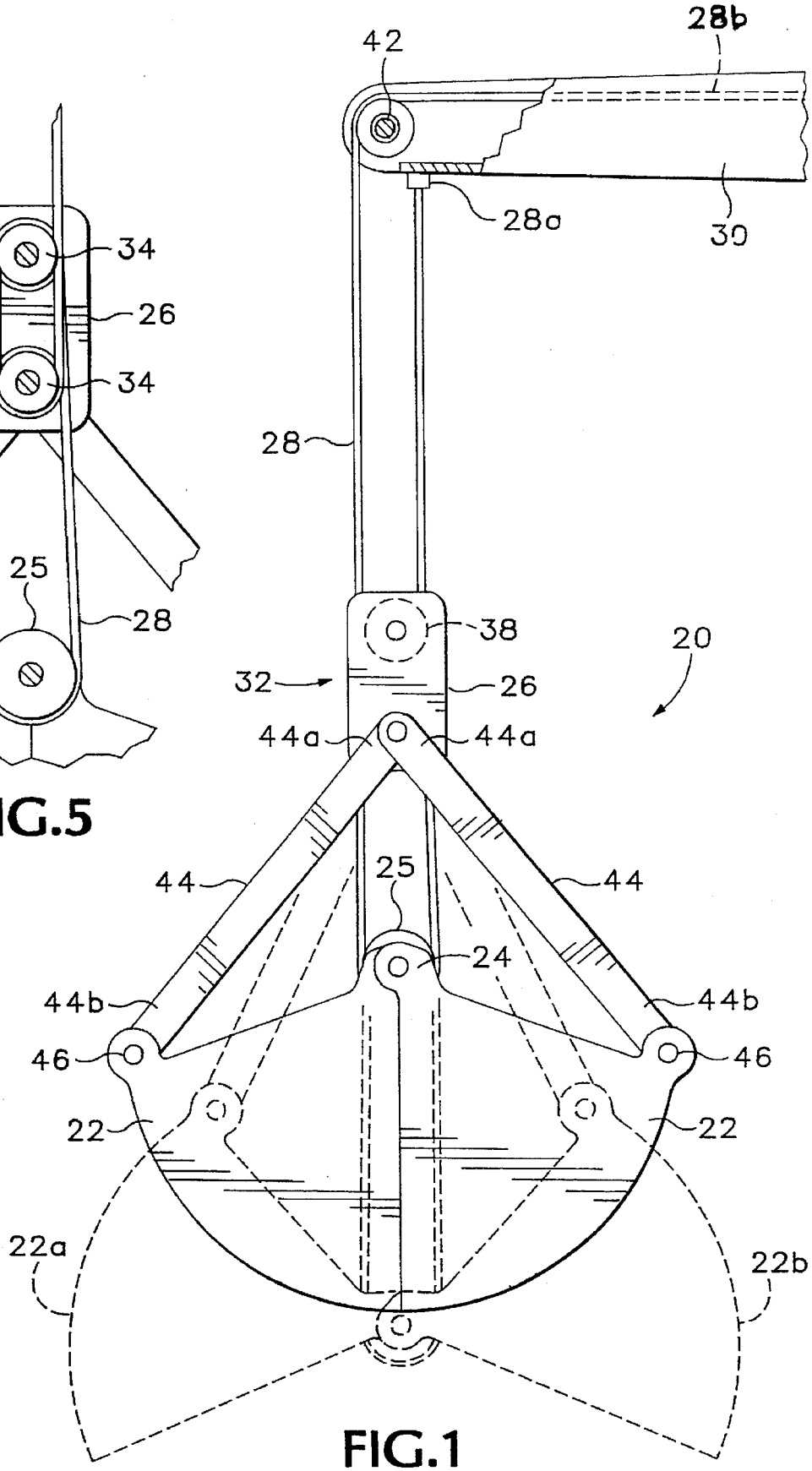
FIG. 1 is a side view of an exemplary embodiment of a single line grab system of the present invention having a retarder on the grab.
Figure 2:
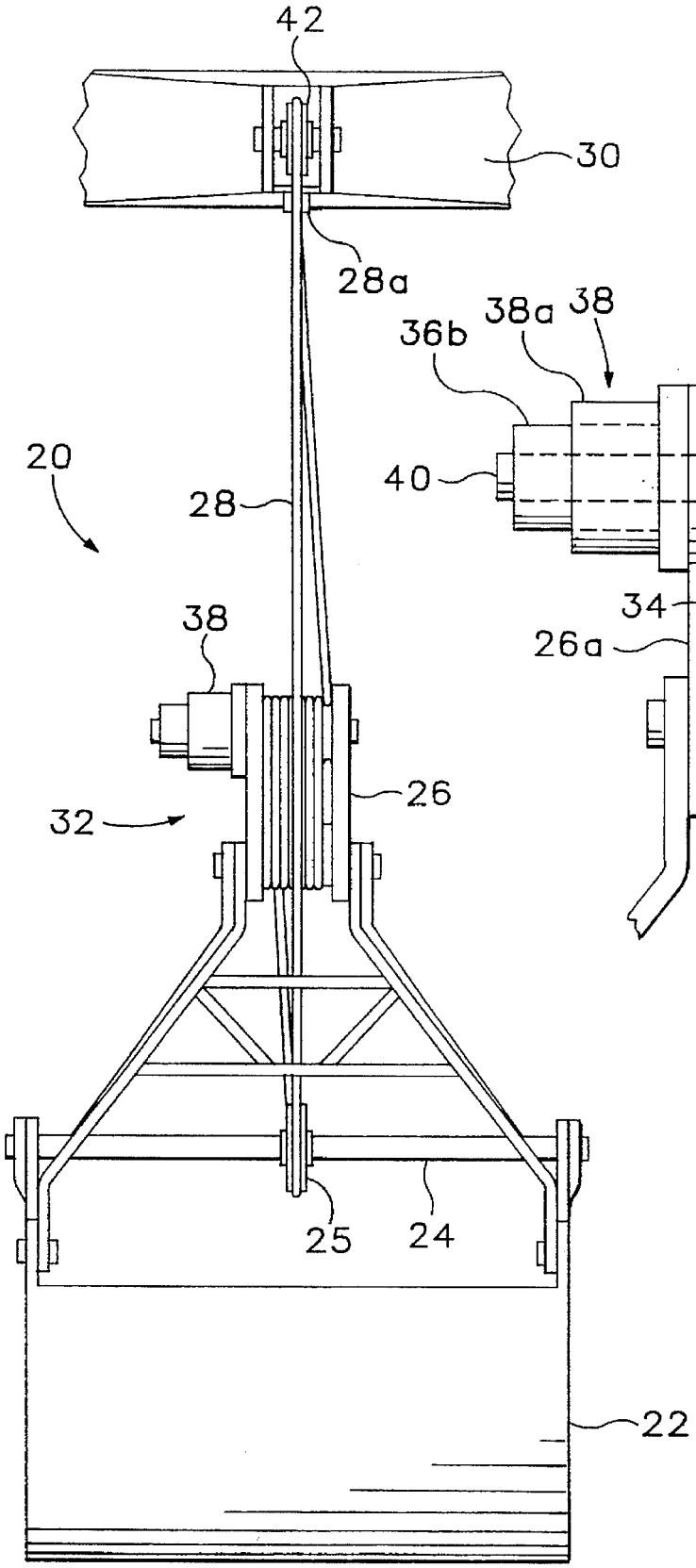
FIG. 2 is a front view of the single line grab system of FIG. 1.
Figure 3:
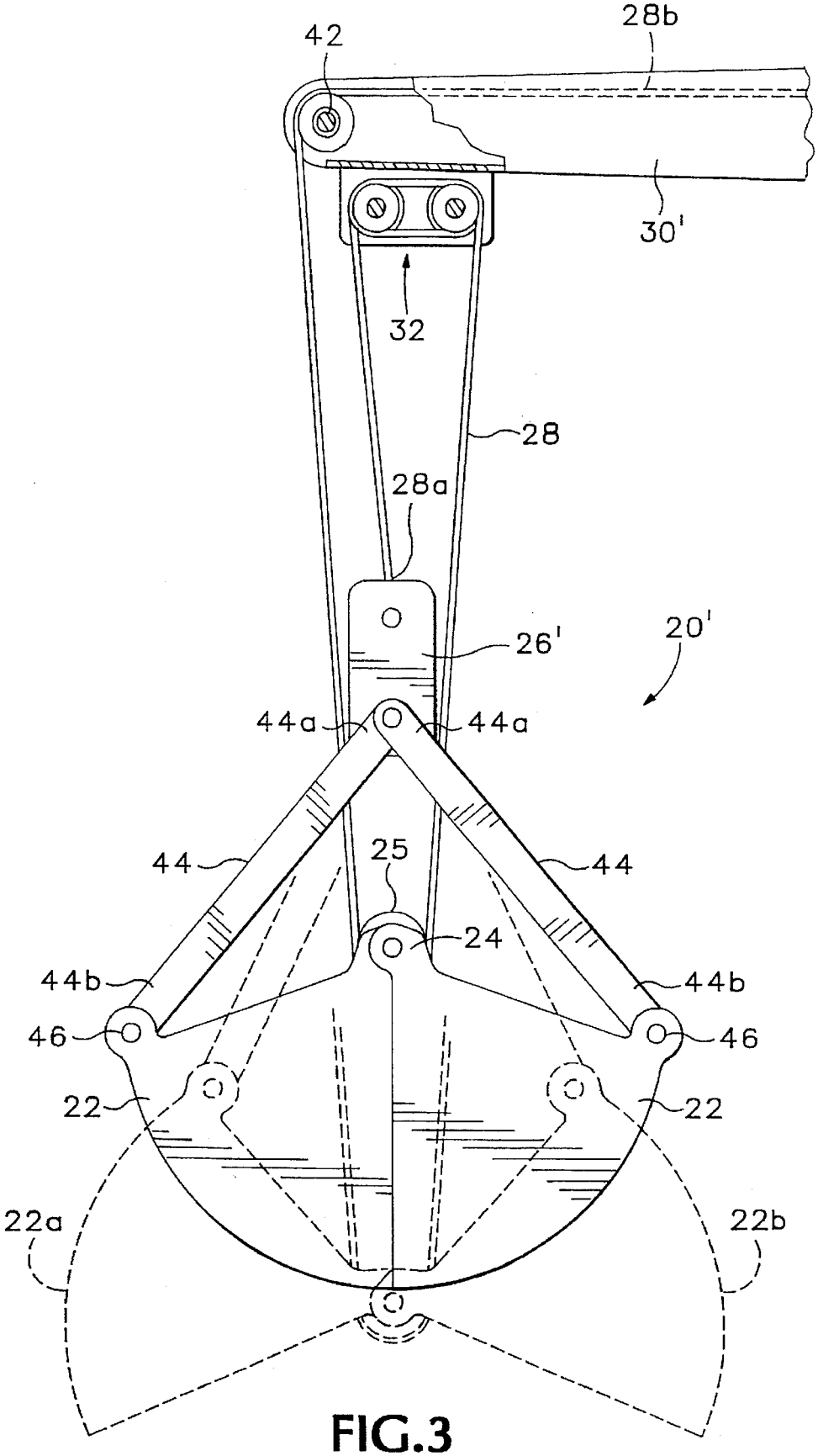
FIG. 3 is a side view of an exemplary embodiment of a single line grab system of the present invention having a retarder on the boom.
Figure 4:
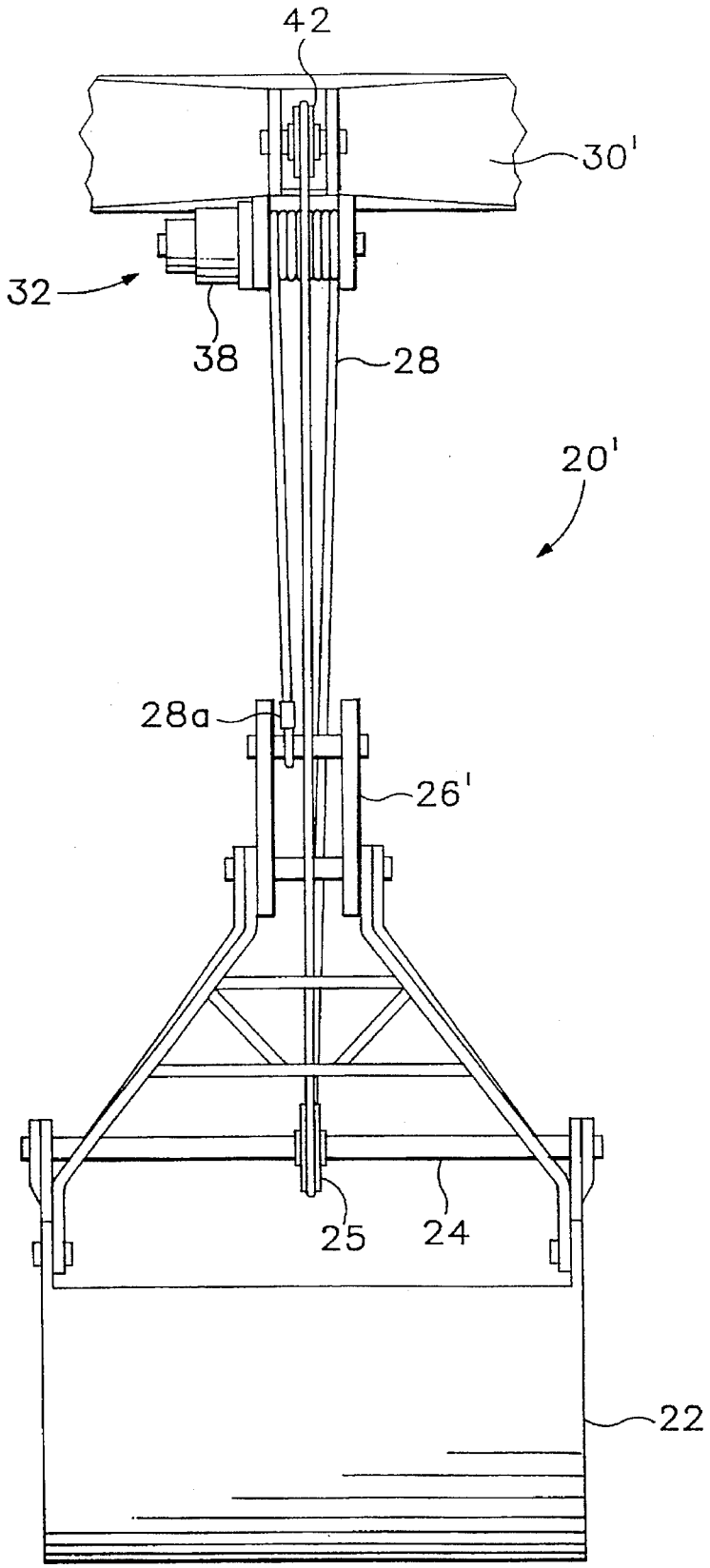
FIG. 4 is a front view of the single line grab system of FIG. 3.

The grab system of the present invention may be implemented in several ways. FIGS. 1 and 2 show an exemplary embodiment of the grab system 20 having the retarder 32 on the head assembly 26 and the first end **28*a* of line 28 anchored to a boom 30, or other mounting surface. FIGS. 3 and 4 show an alternate embodiment of the grab system 20' having the retarder 32 on the boom 30' and the first end 28*a* of line 28 anchored to the head assembly 26'**.

In the embodiment of the grab system 20 shown in FIGS. 1 and 2 the retarder 32 is mounted on the head assembly 26 and the first end 28*a* is interconnected with the boom 30. The line 28 passes through and engages with the retarder 32 on the head assembly 26. The line 28 then wraps at least partially around the pulley 25 of the central pivot assembly 24. The line 28 passes from the pulley 25 upward, past the head assembly 26, to a pulley 42 mounted on the boom 30. The line 28 at least partially wraps around the pulley 42 and extends to the second end 28*b*.

In the embodiment of the grab system 20' shown in FIGS. 3 and 4, the first end 28*a* of the line 28 is interconnected with or attached to the head assembly 26' and the retarder 32 is mounted below the boom 30'. More specifically, the line 28 extends from where it is attached to the head assembly 26' upward to the retarder 32 mounted on the boom 30'. The line 28 engages with the retarder 32 and then extends downward past the head assembly 26'. The line 28 continues downward to the pulley 25 having a pulley around which the line 28 at least partially wraps. The line 28 then passes upward past the head assembly 26' to a pulley 42 mounted on the boom 30'. The line 28 at least partially wraps around the pulley 42 and extends to the second end 28*b*.

Figure 6:
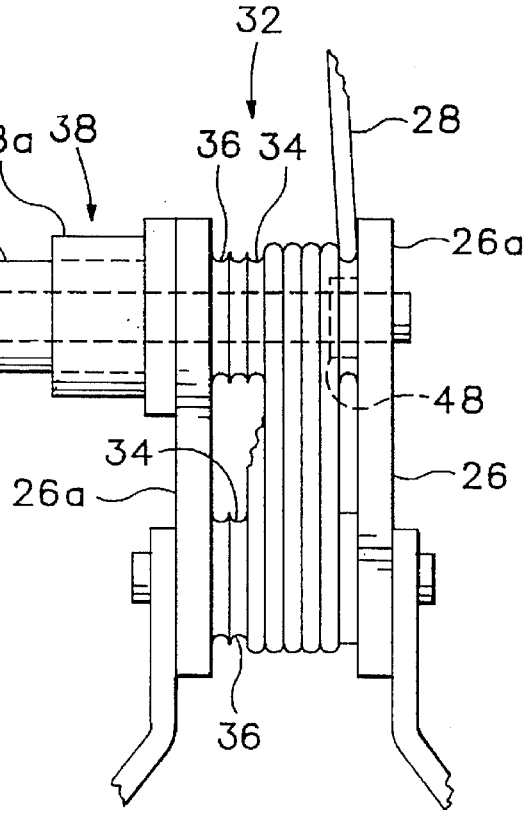
FIG. 6 is an enlargement of a front view of the retarder system of FIG. 1.

As shown in detail in FIGS. 5 and 6, the selectively actuated retarder 32 or traction drive system preferably includes at least one, and preferably two, rotatable drums 34 about which the line 28 is at least partially wrapped. The outer diameter of each drum 34 has at least one circumferential groove 36 (FIG. 6). Preferably, each drum 34 has a plurality of circumferential grooves 36 that are separate from adjacent groves 36 (as opposed to each drum 34 having a single spiral groove). The line 28 alternately wraps at least partially around a groove 36 of a first drum 34 and then wraps at least partially around a groove 36 of a second drum 34. The line 28 is then preferably wrapped alternately around each of the grooves 36 on the drums 34 in a similar continuous manner.

The retarder system 32 preferably includes a speed-actuated viscous retarder or coupling 38 which is interconnected with at least one of the drums 34 to selectively retard its rotation. In the embodiment of FIG. 6, the drum 34 is fixed to a rotatable shaft 40 (shown in dotted lines in FIG. 6) and, through the shaft 40, to a hub 38*b* of the viscous coupling 38, with a housing 38*a* of the viscous coupling 38 affixed to end plates 26*a* of the head assembly 26. Alternately, the shaft 40 and hub 38*b* could be fixed to end plates 26*a* so that the drum 34 rotates on the shaft 40, with the housing 38*a* of the viscous coupling 38 affixed directly to the drum 34 to rotate in unison therewith. The coupling 38 retards the drum 34 at high speed, but not at low speed.

A conventional sprag clutch 48 is also preferably included in the retarder system 32 so that the viscous coupling 38 only retards the drums 34 in one direction of rotation (i.e., the direction corresponding to feeding of the line 28) and is totally non-retarding in the opposite direction. For example, in the embodiment of FIG. 6, a sprag clutch 48 could be located between the drum 34 and the shaft, 40 as shown, or between the shaft 40 and hub 38*b*, so that the fixation of the respective elements to each other depends on the direction of rotation. During withdrawal of the line 28, the sprag clutch operatively disconnects the elements. Including a sprag clutch 48 effectively allows an operator to raise the bucket 22 at high speed while disabling the retarder 32 (which high speed would otherwise apply the retarder 32), as will be explained more fully hereafter.

One type of viscous coupling 38 which may be used includes a first set of discs (not shown) surrounding the hub 38*b* and attached to the coupling housing 38*a*, and a second set of discs (not shown) interspersed between the first set of discs and attached to the hub 38*b* so that viscous fluid passes between the first and second sets of plates. U.S. Pat. No. 5,404,978 to Hagiwara and U.S. Pat. No. 5,419,417 to Madsack, both incorporated herein by reference, disclose exemplary viscous couplings which could be used in the present invention.

Preferably, the drag created by the retarder system 32 may be adjusted to accommodate different types of operation. For example, in dredging operations it is preferable to set the drag to a minimal level so that the bucket 22 lowers at a high speed. This would allow the bucket 22 to engage the material at high speed and "take a bite" out of the material. Contrarily, for operations involving barges or trucks, it is preferable to set the drag at a high level so that the bucket 22 lowers at a 5 low speed. This slow speed allows a soft landing which would not damage the barge or truck.

Alternate embodiments of the present invention could employ a retarder of the type that utilizes a traditional brake that clamps or otherwise engages line 28 selectively, in place of the viscous retarder 32 disclosed above. For example, a remotely controlled hydraulic or solenoid brake could be applied or disabled selectively, and need not be speed-actuated. However, a separate remote control circuit or system would have to be provided for selective control of such a brake, whereas none is needed for the speed-actuated viscous coupling 38.

The viscous coupling 38, as shown, is arranged to be "torque free" when the drums 34 rotate in a forward direction (corresponding to the line 28 being fed) below a predetermined speed. When the coupling 38 is "torque free" the retarder 32 is effectively disabled. As the forward rotating speed of the drum increases (by increasing the rate at which the line 28 is fed), the viscous friction created between the sets of discs creates a drag or braking force sufficient to retard the descent of the head 26 relative to the central pivot assembly 24, and thus to open the bucket 22 while it is being lowered as shown in phantom in FIG. 1. In other words, increasing the rate of feed of the line 28 selectively causes the retarder 32 to be applied. By feeding the line 28 and adjusting the rate at which the line 28 is fed through the retarder system 32, the head 26 can descend freely, or descend with a set amount of drag relative to the central pivot assembly 24, which corresponds to the bucket 22 being lowered while closed or being lowered while opening, respectively.

The embodiment of FIGS. 3 and 4 operates on the same principle as the embodiment of FIGS. 1 and 2.

Using the sprag clutch 48, as discussed above, effectively allows an operator to raise the bucket 22 by withdrawing the line 28 at either high speed or low speed with no difference in operation, because the retarder 32 is disabled. Withdrawing the line 28 also closes the bucket 22. The grab system 20 or 20' would remain operative even if the sprag clutch 48 were omitted; however, the rate of speed that the line 28 was withdrawn would determine whether the retarder 32 would be applied or disabled. Therefore, if the sprag clutch 48 were omitted, withdrawing the line 28 slowly through the retarder system 32 would disable the retarder 32 and the bucket 22 would close and raise properly at slow speed. Withdrawing the line 28 quickly would likewise close the bucket 22, but would apply the retarder 32 to the line 28 which would hinder the passage of the line through the retarder and cause the end 26*a* of the line to become slack during subsequent raising.

The method for operating the grab system 20 or 20' essentially involves two variables: first, the line 28, may be selectively withdrawn or fed and second, the retarder 32 may be selectively disabled or applied to a portion of the line 28. Using these two variables, the grab or bucket 22 may be selectively opened or closed and selectively raised or lowered. The bucket 22 may be lowered by disabling the retarder 32 and feeding the line 28. The bucket 22 may be opened by applying the retarder 32 and feeding the line 28. The bucket 22 may be raised by disabling the retarder 32 and withdrawing the line 28. The bucket 22 may be closed by withdrawing the line 28.

The step of opening the bucket 22 more specifically is comprised of retarding the motion of the head assembly 26 or 26' relative to a portion of the line 28 without similarly retarding the motion of central pivot assembly 24 relative to the portion of the line 28. This can be done using the embodiment shown in FIGS. 1 and 2 with the retarder 32 mounted on the head assembly 26 or using the embodiment shown in FIGS. 3 and 4 with the retarder 32 mounted remote from the head assembly 26'.

It should be noted that the head assembly 26 or 26' is preferably connected to the bucket members 22 by arms 44 having a first end **44*a* and a second end 44*b*. The first end 44*a* of each arm 44 is pivotably connected to the head assembly 26 or 26'. The second end 44*b* of each arm 44 is pivotably connected to a bucket member 22*a* or 22*b*. Preferably, the second end 44*b* of each arm is connected to an arm pivot 46 remote from the central pivot assembly 24**.

It should be noted that alternate grabs may be used in place of bucket 22 including, for example, a claw grab or an "orange peel" grab. It should also be noted that since the head assembly 26' shown in FIGS. 3 and 4 does not incorporate the retarder 32, an alternate head assembly 26' could be used. For example, the head assembly 26' could have a single pivot from which the first ends **44*a* of the arms 44 pivot. The first end 28*a* of the line 28** may also be attached to that single pivot.

Moreover, line arrangements having more portions of line 28 and more pulleys than those shown in the drawings may be employed in a conventional manner without departing from the present invention, depending upon the mechanical advantage desired.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for operating a grab, suspended only by a continuous single line, by selectively withdrawing or feeding the line and selectively disabling or applying a retarder with respect to a portion of said line, said method comprising the steps of:

(a) lowering the grab by disabling the retarder and feeding the line;

(b) opening the grab by applying the retarder and feeding the line; and (c) raising the grab by disabling the retarder and withdrawing the line.

2. The method of claim 1 further comprising the step of closing the grab by withdrawing the line.

3. The method of claim 1 wherein step (b) comprises retarding the motion of an upper element of said grab relative to said portion of said line without similarly retarding the motion of a lower element of said grab relative to said portion of said line.

4. The method of claim 3 including mounting said retarder upon said upper element of said grab.

5. The method of claim 3 including mounting said retarder remote from said upper element of said grab and interconnecting said retarder with said upper element through said portion of said line.

6. The method of claim 1 wherein the step of disabling said retarder in step (a) includes moving said line at a relatively slow speed.

7. The method of claim 1 wherein the step of disabling said retarder in step (c) includes operatively disconnecting the retarder with respect to said portion of said line.

8. The method of claim 1 wherein the step of applying said retarder includes moving said line at a relatively fast speed.

9. A single line grab comprising:

(a) a grab having at least two grab members pivotably interconnected by a central pivot assembly;

(b) a head assembly connected to said grab members from above said grab members and vertically movable with respect thereto;

(c) only a continuous single line suspending said grab, said single line being anchored at a first end and selectively extensible and retractable at a second end; and (d) a retarder engaging a portion of said single line.

10. The single line grab of claim 9 wherein said single line is anchored to said head assembly.

11. The single line grab of claim 9 wherein said single line is anchored to a boom from which said grab is suspended.

12. The single line grab of claim 9 wherein said retarder is mounted on said head assembly.

13. The single line grab of claim 9 wherein said retarder is mounted on a boom from which said grab is suspended.

14. The single line grab of claim 9 wherein said single line suspends said grab from a boom, said single line grab further comprising:

(a) said first end of said single line being interconnected with said boom at a first location;

(b) said retarder being mounted on said head assembly and said single line passing from said first location through said retarder to said central pivot assembly;

(c) said central pivot assembly having a first pulley under which said single line is wrapped;

(d) said single line passing from said first pulley upward to a second pulley mounted on said boom at a second location thereon, said single line at least partially wrapping around said second pulley; and (e) said single line extending from said second pulley to said second end.

15. The single line grab of claim 9 wherein said single line suspends said grab from a boom, said single line grab further comprising:

(a) said first end of said single line being interconnected with said head assembly;

(b) said retarder being mounted on said boom and said single line passing through said retarder to said central pivot assembly;

(c) said central pivot assembly having a first pulley under which said single line is wrapped;

(d) said single line passing from said first pulley upward and to a second pulley mounted on said boom, said single line at least partially wrapping around said second pulley; and (e) said single line extending from said second pulley to said second end.

16. The single line grab of claim 9 said retarder comprising at least one selectively retarded rotatable drum about which said single line is at least partially wrapped.

17. The single line grab of claim 9 said retarder comprising at least two rotatable drums, each said drum having an outer diameter with at least one circumferential groove, said single line alternately wrapping at least partially around a groove of a first drum and wrapping at least partially around a groove of a second drum.

18. The single line grab of claim 17 wherein each of said drums has a plurality of circumferential grooves and said single line wraps alternately between said first drum and said second drum so that the single line is threaded through each of said grooves on said drums.

19. The single line grab of claim 9 wherein said retarder comprises a viscous retarder.

20. The single line grab of claim 9 wherein said grab is a bucket grab and said grab members are halves of a bucket grab.

21. The single line grab of claim 9 wherein said retarder has an adjustable drag pressure.

22. A grab system suspended by a boom, said grab system comprising:

(a) a grab having at least two grab members pivotably interconnected by a central pivot assembly;

(b) a head assembly connected to said grab members from above said grab members and vertically movable with respect thereto;

(c) a continuous line suspending said grab, said line being anchored at a first end and selectively extensible and retractable at a second end;

(d) a retarder engaging a portion of said line, said retarder being mounted on said boom;

(e) said first end of said line being interconnected with said head assembly;

(f) said line extending upward from said head assembly and passing through said retarder;

(g) said line extending downward to said central pivot assembly, said central pivot assembly having a first pulley under which said line is wrapped;

(h) said line passing from said first pulley upward to a second pulley mounted on said boom, said line at least partially wrapping around said second pulley; and (i) said line extending from said second pulley to said second end.

23. A grab system suspended by a boom, said grab system comprising:

(a) a grab having at least two grab members pivotably interconnected by a central pivot assembly;

(b) a head assembly connected to said grab members from above said grab members and vertically movable with respect thereto;

(c) a continuous line suspending said grab, said line being anchored at a first end and selectively extensible and retractable at a second end;

(d) a retarder engaging a portion of said line, said retarder being mounted on said head assembly;

(e) said first end of said line being interconnected with said boom at a first location;

(f) said line passing through said retarder to said central pivot assembly;

(g) said central pivot a, assembly having a first pulley under which said line is wrapped;

(h) said line passing from said first pulley upward both to a second pulley mounted on said boom at a second location thereon, said line at least partially wrapping around said second pulley; and (i) said line extending from said second pulley to said second end.

* * * * *

UNITED STATES PATENT AND TRADEMARK OFFICE

CERTIFICATE OF CORRECTION

PATENT NO. : 5,649,729

DATED : July 22, 1997

INVENTOR(S) : Robert L. Peterson

It is certified that error appears in the above-indentified patent and that said Letters Patent is hereby corrected as shown below:

| | | | |
|---|---|---|---|
| Col. 1, | Line 17: | Delete "4,528,987" and insert --4,328,987--. |
| Col. 1, | Line 62: | Insert --, -- after "system". |
| Col. 2, | Line 21: | Delete --take-- before "following" insert --the--. |
| Col. 4, | Line 16: | Delete --5-- before "low speed". |
| Col. 7, | Line 4: | Insert --, -- after "claim 9". |
| Col. 8, | Line 28: | Delete --a, -- before "assembley". |

Signed and Sealed this

Fifth Day of May, 1998

*Attest:*

*Attesting Officer*

BRUCE LEHMAN

*Commissioner of Patents and Trademarks*